US007039967B1

(12) United States Patent
Dodge

(10) Patent No.: US 7,039,967 B1
(45) Date of Patent: May 9, 2006

(54) CONVERTIBLE FURNITURE FRAME

(75) Inventor: Peter W. Dodge, Birchwood, WI (US)

(73) Assignee: Night and Day Furniture, L.L.C., Vancouver, WA (US)

( * ) Notice: Subject to any disclaimer, the term of this patent is extended or adjusted under 35 U.S.C. 154(b) by 0 days.

(21) Appl. No.: 10/723,756

(22) Filed: Nov. 26, 2003

Related U.S. Application Data

(60) Provisional application No. 60/429,660, filed on Nov. 27, 2002.

(51) Int. Cl.
*A47C 17/17* (2006.01)

(52) U.S. Cl. ..... 5/37.1; 5/47

(58) Field of Classification Search ..... 5/37.1, 5/38, 47, 12.1; 297/354.13, 354.1
See application file for complete search history.

(56) References Cited

U.S. PATENT DOCUMENTS

| | | | | | |
|---|---|---|---|---|---|
| 2,244,470 | A * | 6/1941 | Neunherz | 5/38 |
| 2,730,727 | A * | 1/1956 | Schneller | 5/38 |
| 2,751,605 | A * | 6/1956 | Sogge | 5/38 |
| 3,002,198 | A * | 10/1961 | Kaiser, Jr. | 5/41 |
| 4,939,802 | A * | 7/1990 | Lafer | 5/42.1 |
| 5,146,640 | A * | 9/1992 | Barton et al. | 5/47 |
| 5,153,952 | A | 10/1992 | Barton et al. | 5/47 |
| 5,170,519 | A | 12/1992 | Meade | 5/37.1 |
| 5,303,432 | A | 4/1994 | Fitts | 5/37.1 |
| 5,315,722 | A * | 5/1994 | Djie | 5/37.1 |
| 5,327,591 | A * | 7/1994 | Fireman et al. | 5/47 |
| 5,429,415 | A | 7/1995 | Meade | 297/354.13 |
| 5,509,151 | A * | 4/1996 | Fireman et al. | 5/37.1 |
| 5,519,902 | A * | 5/1996 | Meade | 5/38 |
| 5,722,101 | A * | 3/1998 | Grigoriev | 5/37.1 |
| 5,956,785 | A * | 9/1999 | Fireman | 5/37.1 |
| 6,298,504 | B1 | 10/2001 | Fireman | 5/37.1 |
| 6,349,431 | B1 | 2/2002 | Meade et al. | 5/37.1 |
| 6,427,261 | B1 | 8/2002 | Chadbourn | 5/18.1 |
| 6,668,395 | B1 * | 12/2003 | Chen | 5/47 |

* cited by examiner

*Primary Examiner*—Robert G. Santos
(74) *Attorney, Agent, or Firm*—Jacobson & Johnson

(57) ABSTRACT

A furniture frame comprising a backrest section having a first side and a second side with the backrest section having at least one wheel rotatably secured to the backrest section and at least one backrest support member secured to the backrest section for supporting the backrest section on a support surface, a prop bar secured to the supporting member, a seat section connected to the backrest section with the seat section having a first side and a second side and including at least one seat support member for supporting the seat section on the support surface, and at least one catch member secured to one of the side of the backrest section with the catch member having at least one notch for engaging a portion of the prop bar therein for supporting the furniture frame in a couch condition.

20 Claims, 12 Drawing Sheets

CONVERTIBLE FURNITURE FRAME

CROSS REFERENCE TO RELATED APPLICATIONS

This application claims priority to U.S. Provisional Application Ser. No. 60/429,660, which was filed on Nov. 27, 2002.

FIELD OF THE INVENTION

This invention relates to furniture frames, and more specifically to a furniture frame that is convertible between a bed position and a couch position.

STATEMENT REGARDING FEDERALLY SPONSORED RESEARCH OR DEVELOPMENT

None

REFERENCE TO A MICROFICHE APPENDIX

None

BACKGROUND OF THE INVENTION

Furniture frames that are convertible between a bed position and a couch position are known in the art. The aforementioned convertible furniture frames allow users to maximize the use of a limited living space such as that of a studio or a small apartment by reducing the space dedicated for the furniture. That is, instead of requiring a space in the apartment dedicated solely for the user's bed and another space in the apartment dedicated solely for the user's couch or sofa, the use of the convertible furniture frame allow the user to eliminate one of the aforementioned dedicated furniture spaces thereby providing the user with increase living space.

Although prior art convertible furniture frames function effectively to provide the user with increase living space, they often lack stability and sturdiness which results in difficulties in their conversion between the bed and couch position. In addition, due to their lack of stability and sturdiness, the aforementioned furniture frames also can be quite troublesome to move from one place to another.

The present invention provides for a furniture frame that is substantially effortless to convert between the bed position and the couch position while further providing for a furniture frame that is also substantially effortless to move or transport to different areas of a living space.

SUMMARY OF THE INVENTION

The present invention is a convertible furniture frame and methods for converting the furniture frame between the couch position and the bed position. The furniture frame includes a backrest section and a seat section with the backrest section comprising a first side and a second side. Each of the sides of the backrest section includes a backrest support member connected thereto for supporting the backrest section on a support surface. Connecting the supporting members to each other is a prop bar which function to guide the movement of the backrest support members in a simultaneous manner. The backrest section also includes at least one wheel rotatably secured to the backrest section, the at least one wheel allowing a user to effortlessly move the furniture frame from one location to another location.

The seat section comprises a first side and a second side with each of the sides of the seat section having a seat support member secured thereto for supporting the seat section on the support surface. The seat section further includes at least one catch member secured to at least one of the sides of the backrest section with the catch member having at least one notch for engaging a portion of the prop bar therein for supporting the furniture frame in the couch position.

DESCRIPTION OF THE DRAWINGS

Figure 1:
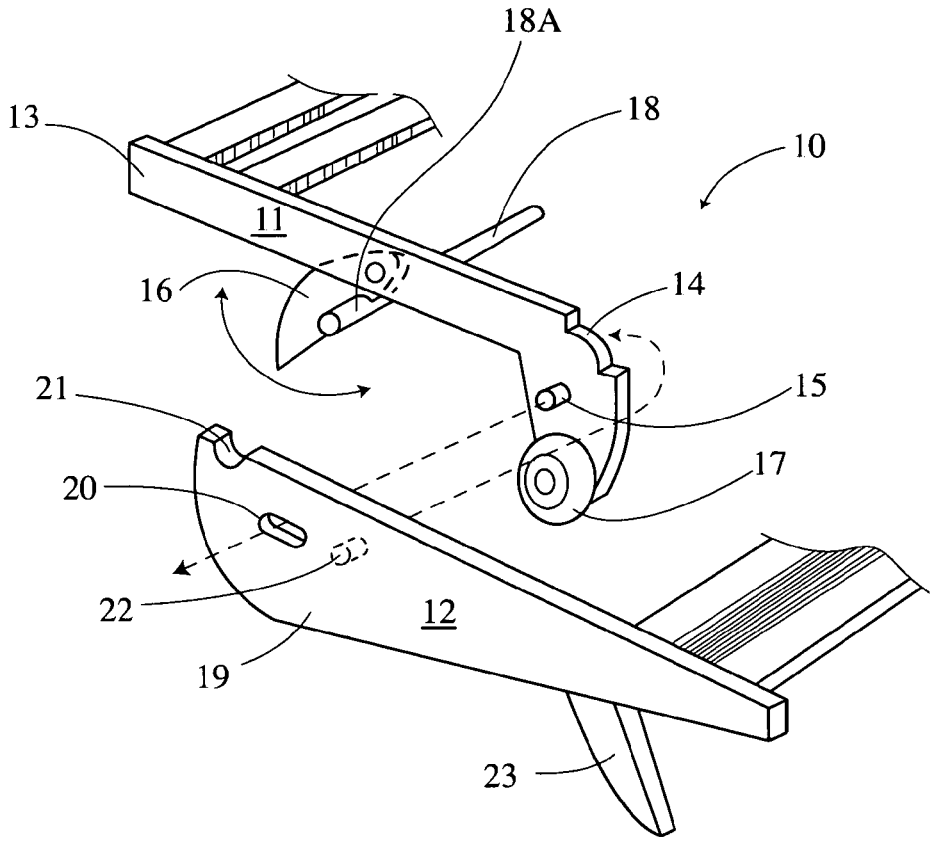
FIG. 1 shows an exploded view of a furniture frame of the present invention.

The present invention comprises a furniture frame 10 convertible between a bed position and a couch position. FIG. 1 shows an exploded view of a furniture frame 10 of the present invention comprising a backrest section 11 and a seat section 12. As shown in the embodiment of FIG. 1, the backrest section 11 includes a L-shape sidewall 13 having a groove 14 located thereon and a protruding member 15 secured thereto. Backrest section 11 also includes a backrest support member 16 swingably secured thereto and a wheel 17 rotatably secured thereto, the backrest support member 16 and wheel 15 function to support the backrest section 11 on a support surface such as a floor.

Figure 3:
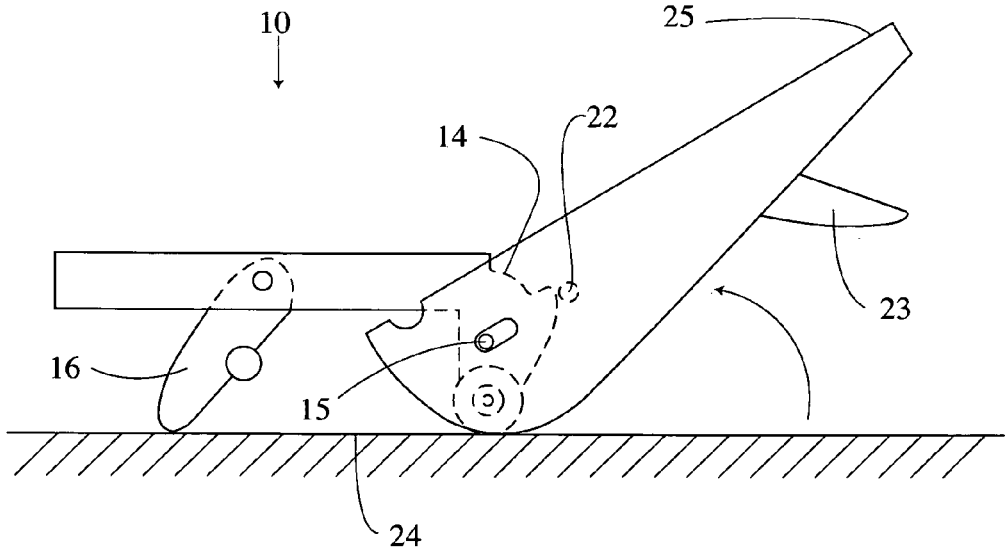
FIG. 3 is a side view showing the furniture frame of the present invention with the front edge of the seat section of the furniture frame being raised.

Although the backrest support member 16 is shown in FIG. 1 secured to the side 13 of the backrest section 11, alternative embodiment of the present invention can include the backrest support member 16 secured to other regions on the backrest section 16. In addition, although one wheel 17 is shown in the embodiment of FIG. 3, alternative embodiments of the present also can include the use of a backrest section 11 having a plurality of wheels rotatably secured thereto.

Also note that while only one side 13 of the backrest section 11 is shown in FIG. 1, both sides of the backrest section in the embodiment of FIG. 1 can include a protruding member secured thereon, a groove located thereon and a wheel rotatably secured thereto.

Backrest section 11, as shown in the embodiment of FIG. 1, further includes a connecting rod or prop bar 18 securely attached to the backrest support member 16. The connection of the backrest support member 16 to the prop bar 18 guides the swinging movement of support member 16 of the backrest section 11.

Although the backrest support member 16 of the present invention is shown in FIG. 1 secured to the side of the backrest section 11, alternative embodiment of the present invention may have the backrest support member 16 secured to different locations on the backrest section 11. Alternative embodiments of the present also may include the use of a backrest section 11 comprising more or less than two wheels, two grooves, and two support members.

As shown in FIG. 1, the seat section 12 of the present invention includes a first side 19 and a second side (not shown) with each of the sides of the seat section having a slot 20 located thereon for receiving the protruding member 15 located on the sides of the backrest section 11 to thereby allow the backrest section 11 to rotatably connect to the seat section 12. Also included on each side of the seat section 12 is a recess 21 for engaging an end 18A of the prop bar 18, a protruding member 22 for engaging the grove of the backrest section 14, and a seat support member 23 secured to each side of the seat section 12 for supporting the seat section 12 on the support surface.

Figure 2:
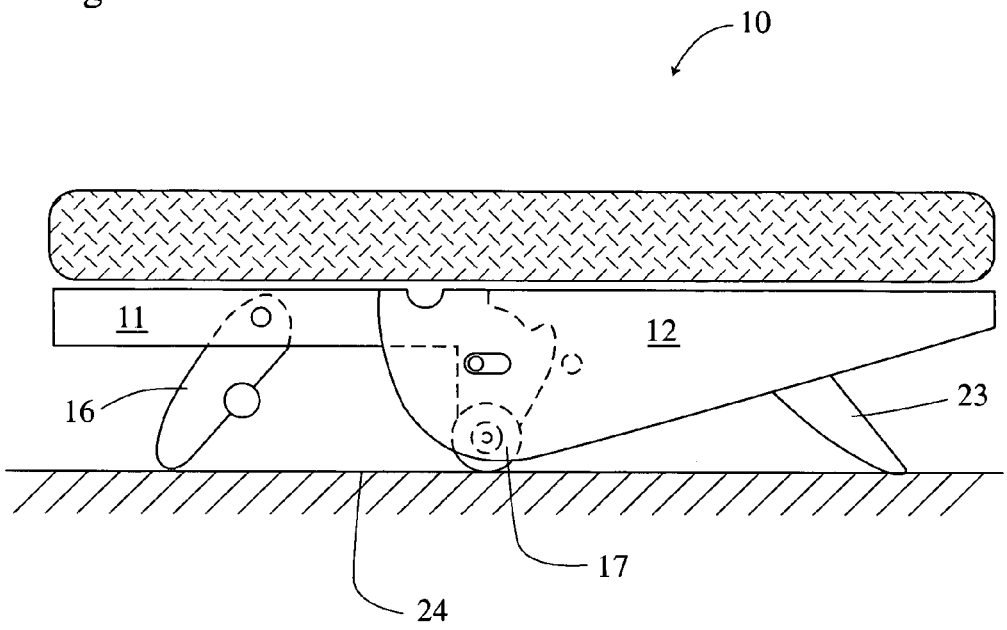
FIG. 2 is a side view showing the furniture frame of the present invention in a bed position.

Referring to FIG. 2, FIG. 2 is a side view showing the furniture frame 10 of the present invention in a bed position. The bed position is characterized by the backrest section 11 and the seat section 12 of the furniture frame 10 positioned in a condition so as to form a flat support surface for supporting a cushion or a mattress such as a futon mattress on the furniture frame 10. As shown in FIG. 2, in the bed position the support member 16 of the backrest section 11 and the support member 23 of the seat section 12 the furniture frame 10 on the support surface 24. In the bed position, the wheel 17 of the backrest section 11 is also in an up position so as not to engage the support surface 24.

FIG. 3 is a side view showing the furniture frame 10 of the present invention with a front end 25 of the seat section 12*b* raised in the start of the process of converting the furniture frame 11 from the bed position to the couch position.

Figure 4:
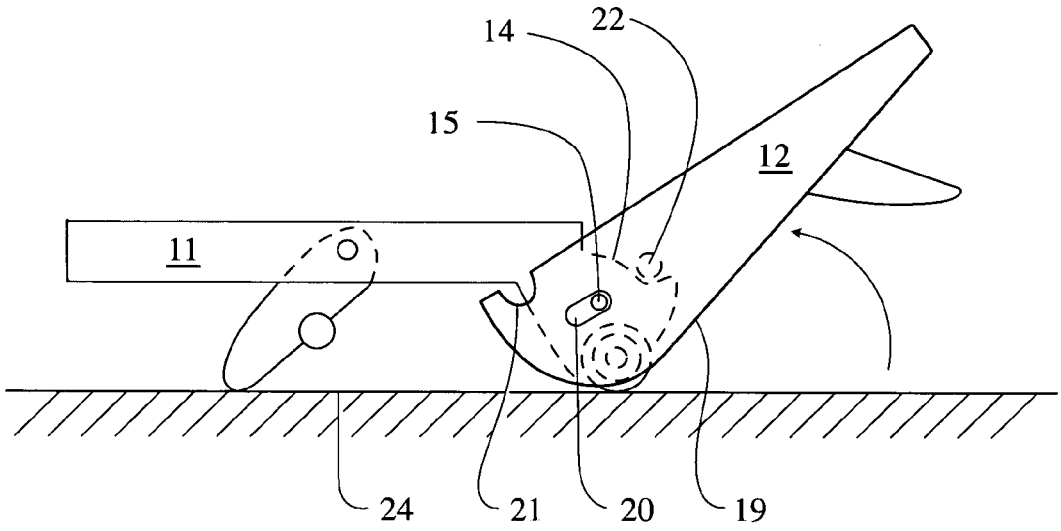
FIG. 4 is a side view showing the protruding members of the seat section of the furniture frame being moved into the groove of the backrest section.

Referring to FIG. 4, FIG. 4 is a side view showing the protruding member 22 of the seat section 12 being moved into the groove 14 of the backrest section 11. During this process, the protruding member 15 of the backrest section is free to slide in slot 20 of the seat section 12. The recess 21 on the side 19 of the seat section 12 and the protruding member 15 of the backrest section 11 make up the hinge between the seat section 12 and the backrest section 11. The movement of the seat section 12 causes the protruding member 22 of the seat section 12 to lock and unlock while in the groove 14 of the backrest section 11 and provides the leverage to raise the backrest section 11.

Figure 5:
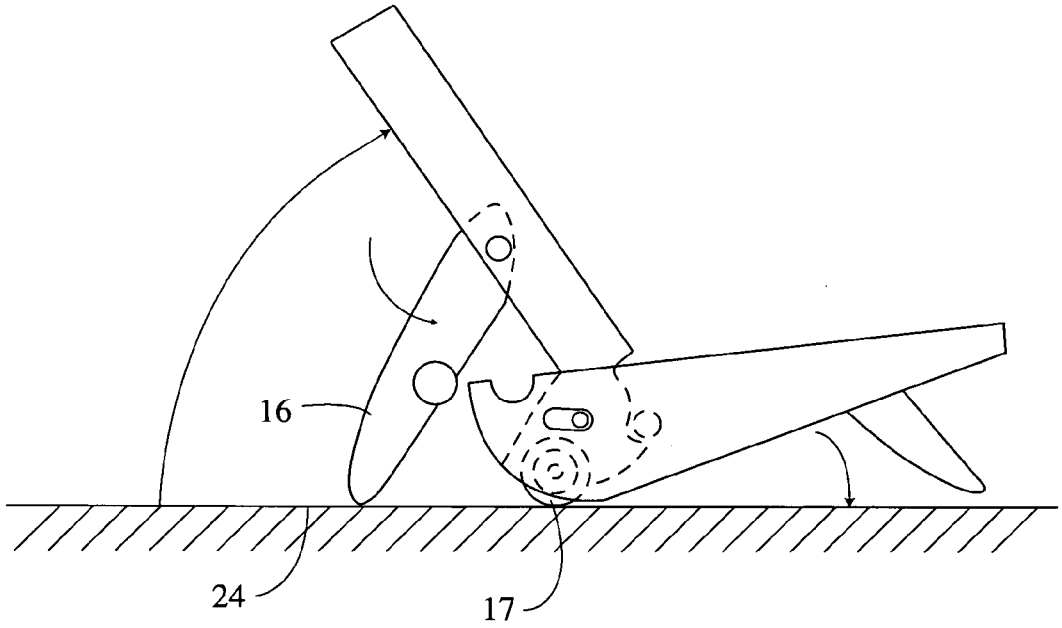
FIG. 5 is a side view showing the wheels of the backrest section engaging a support surface.

FIG. 5 is a side view showing the wheel 17 of the backrest section 11 engaging the support surface 24 as the backrest section 11 is raised. Once the wheel 17 engages the support surface 24, the furniture frame 11 may be rolled to a desired location such as away from a wall or to different locations in a room. As shown in FIG. 5, after the wheel 17 engages the support surface 24, the support member 16 of the backrest 11 is then moved downward closer to the support surface 24.

Figure 6:
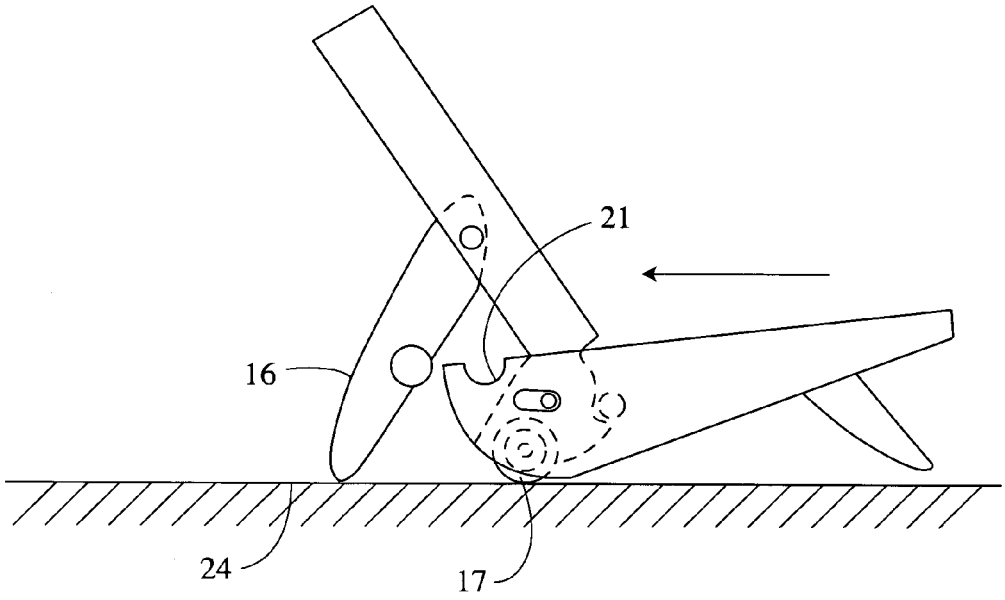
FIG. 6 is a side view showing that the backrest support member and the recess of the seat section being brought into proximity.

FIG. 6 is a side view showing that the backrest support member 16 and the recess 21 of the seat section 12 are brought into proximity of each other as a result of the friction between the support surface 24 and the bottom of the backrest support member 16 and the action of the wheel 17.

Figure 7:
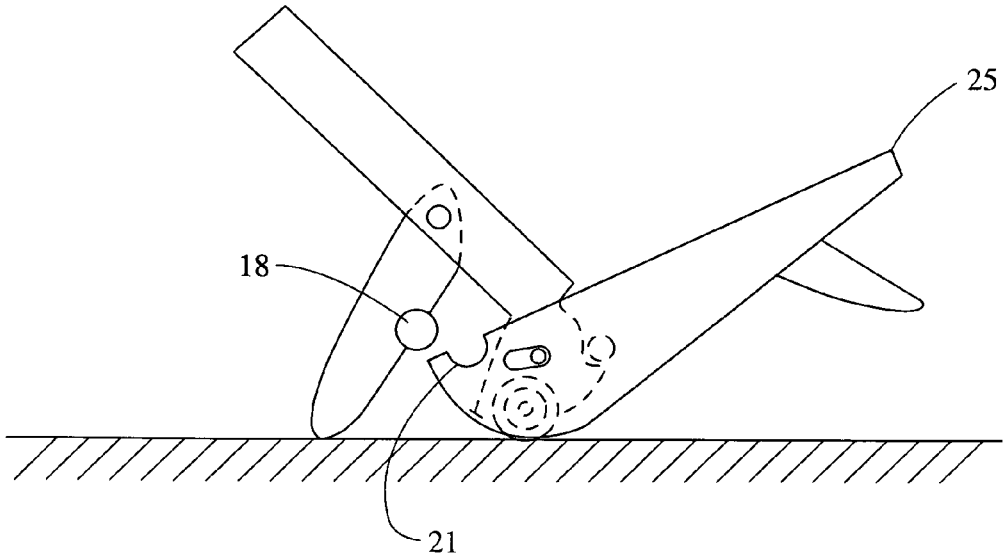
FIG. 7 is a side view showing the front edge of the seat section being raised to lower the recess.

FIG. 7 is a side view showing the front end 25 of the seat section 12 raised to lower the recess 21 of the seat section 12 to allow the recess 21 of the seat section 12 to receive a portion of the prop bar 18.

Figure 8:
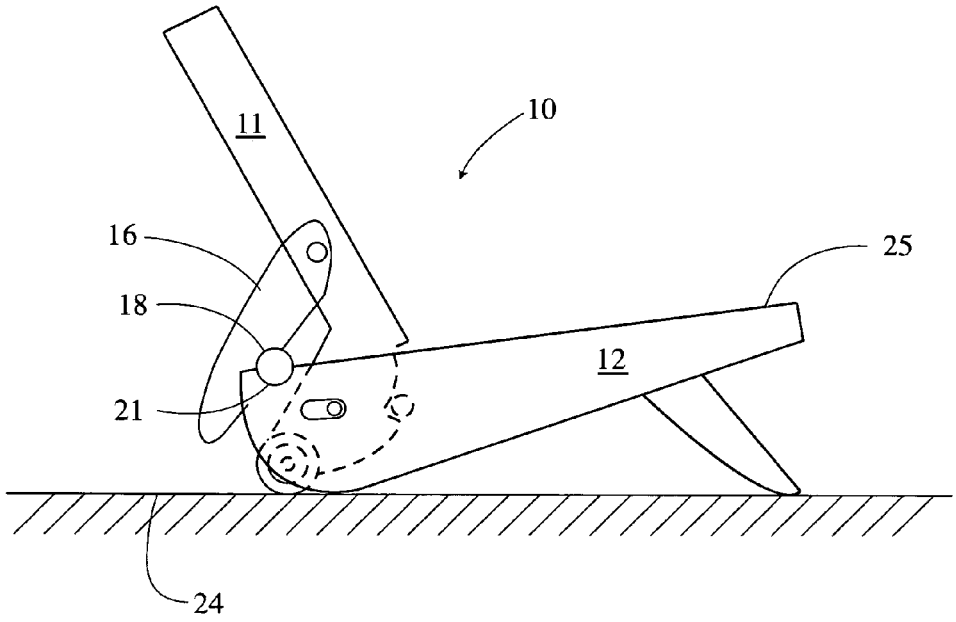
FIG. 8 shows the furniture frame in a couch position.

FIG. 8 shows the lowering of the front end 25 of the seat section 12 leads to the recess 21 of the seat section 12 trapping the prop bar 18 therein to thereby maintain the furniture frame 10 in the couch position. The trapping of the prop bar 18 to the recess 21 of the seat section 12 results in the support member 16 of the backrest section 11 positioned so as not to engage the support surface 24.

Figure 9:
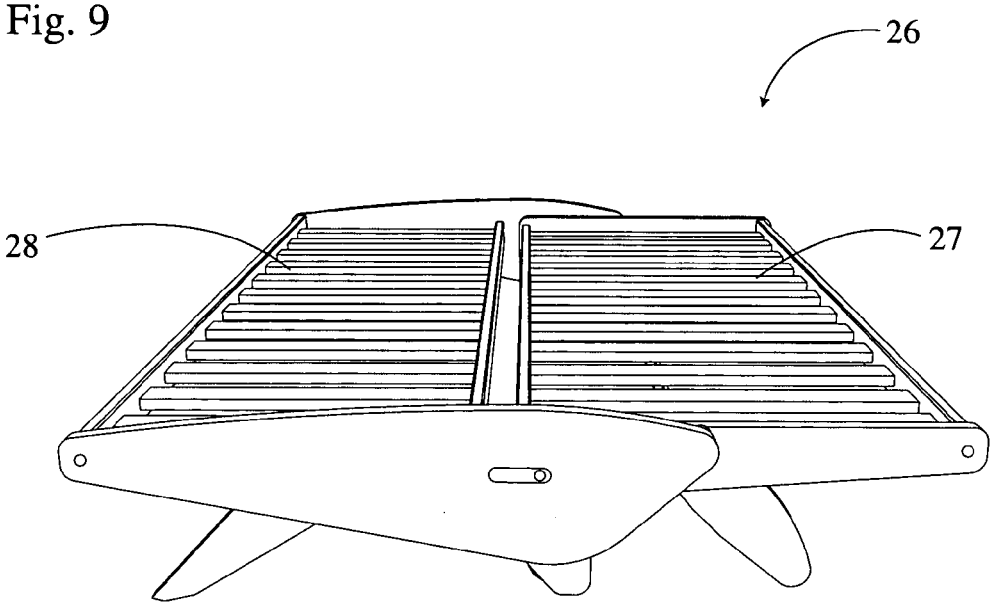
FIG. 9 is a perspective side view showing an alternative embodiment of the furniture frame of the present invention in a bed position.
Figure 10:
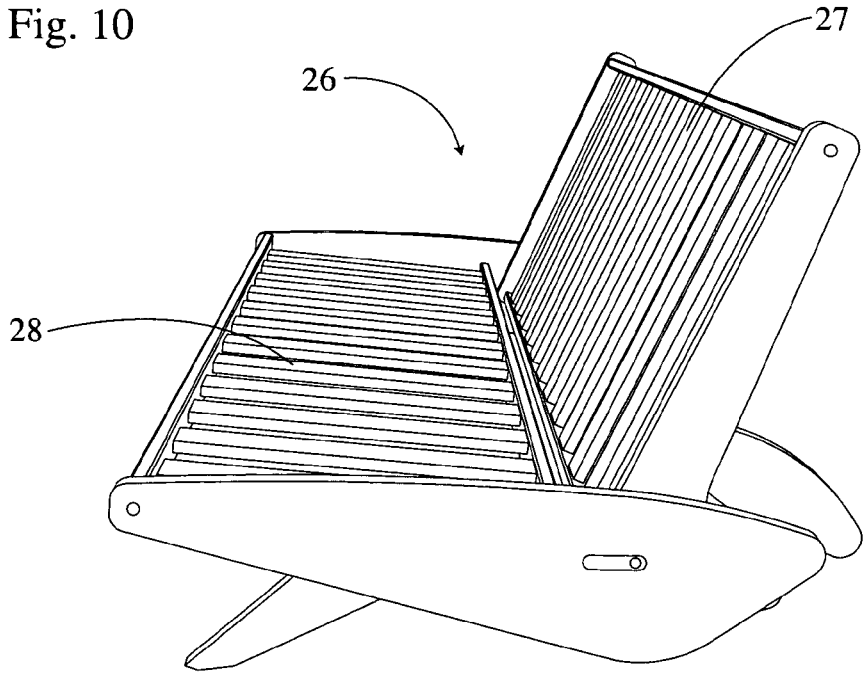
FIG. 10 is a perspective side view showing the furniture frame of FIG. 9 in a couch position.

Referring to FIGS. 9–10, FIG. 9 is a perspective side view showing an alternative embodiment of the furniture frame 26 of the present invention in the bed position. The bed position is characterized by a backrest section 27 and a seat section 28 of the furniture frame 26 configured in a condition so as to form a flat support surface for supporting a cushion or a mattress such as a futon mattress (not shown) on the furniture frame 26.

FIG. 10 is a side view of the furniture frame 26 of the present invention in a couch position. The couch position is characterized by the backrest section 27 and the seat section 28 of the furniture frame 26 disposed at an angle to each other, and more specifically, being disposed at an angle of less then 180 degrees with respect to each other.

Figure 11:
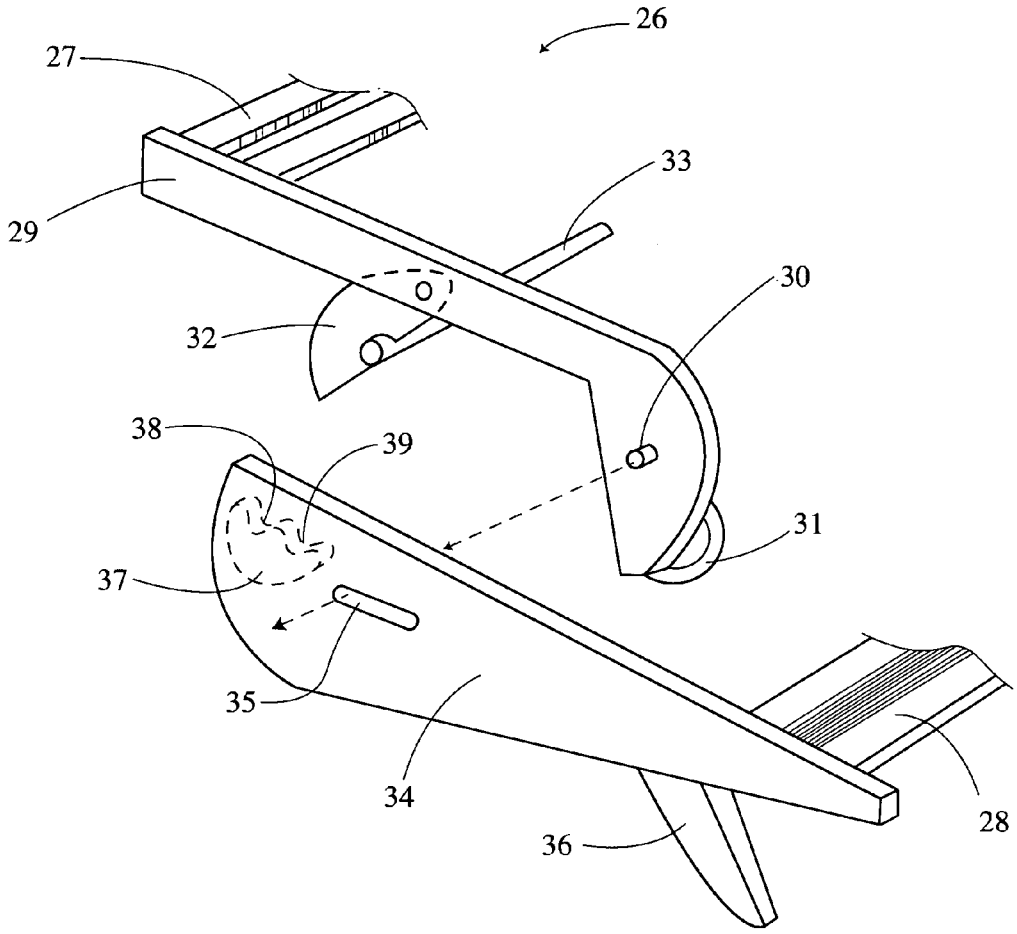
FIG. 11 is a partial exploded view of the furniture frame of FIG. 9.

Referring to FIG. 11, FIG. 11 shows an exploded partial view of the furniture frame 26 of the present invention. Although only one side of the backrest section 27 is shown in FIG. 3, it is intended that both sides of the backrest section 27 in the embodiment of FIG. 3 contains similar corresponding parts.

As shown in the embodiment of FIG. 1, the backrest section 27 includes a L-shape sidewall 29 having a protruding member 30 secured thereon. Backrest section 27 also includes a backrest support member 32 swingingly secured thereto and a wheel 31 rotatably secured thereto, the backrest support member 32 and wheel 31 functions to support the backrest section 27 on a support surface such as a floor.

Although the backrest support member 32 is shown in FIG. 11 secured to the side 29 of the backrest section 27, alternative embodiment of the present invention can include the backrest support member 32 secured to other regions on the backrest section 32. In addition, although one wheel is shown in the embodiment of FIG. 1, alternative embodiments of the present also can include the use of a backrest section 27 having a plurality of wheels rotatably secured thereto.

Backrest section 27, as shown in the embodiment of FIG. 1, further includes a connecting rod or prop bar 33 securely attached to the support member 32. The connection of the support member 32 to the prop bar 33 guides the movement of support member 32 of the backrest section 26.

Seat section 28, as shown in the embodiment of FIG. 11, includes a seat support member 36 secured thereto for supporting the seat section 28 on the support surface. Seat section 28 further includes a sidewall 34 having a slot 35 located thereon for receiving the protruding member 30 of the backrest section 27. The mating engagement between the protruding member 30 of the backrest section 27 and the slot 35 of the seat section 28 allows for the rotatable connection between the backrest section 27 and the seat section 28.

The seat section 28, as shown in the embodiment of FIG. 11, also includes a catch member 37 secured thereto, catch member 37 having a first notch 38 and a second notch 39 for supporting a portion of the prop bar 33 therein when the furniture frame 26 is in the couch position so as to maintain the furniture frame 26 in the couch position. Although catch member 37 is shown in the embodiment of FIG. 11 as having two notches 38 and 39, alternative embodiments of the present invention can comprise catch members having as few as one to a plurality of notches thereon to provide the furniture frame 26 with great adjustability, that is, the ability to adjust the backrest section 26 of the furniture frame 26 to more or less of an upright position when the furniture frame 26 is in the couch position.

Figure 12:
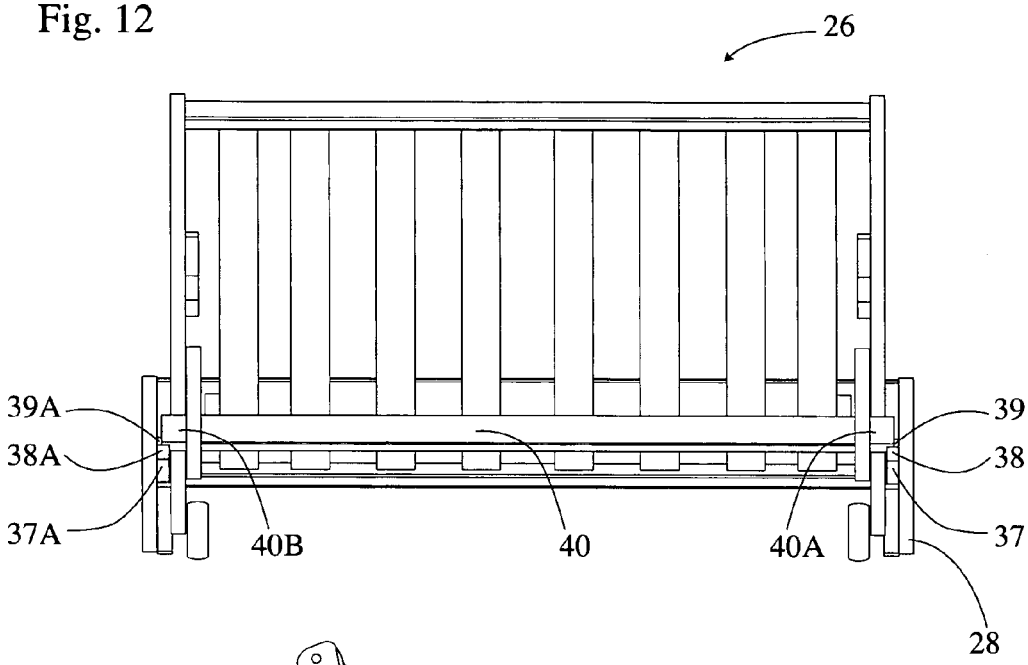
FIG. 12 shows a rear view of the furniture frame of FIG. 9 in the couch position.
Figure 13:
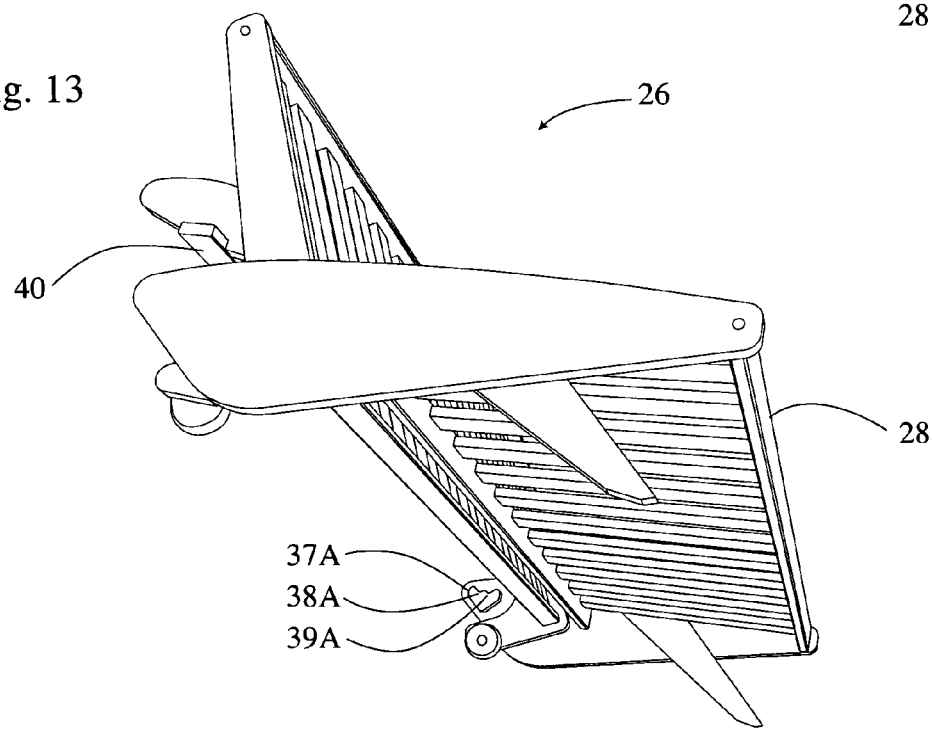
FIG. 13 shows a bottom perspective view of the furniture frame of FIG. 9 in the couch position.

Referring to FIGS. 12 and 13, FIG. 12 shows a rear view and FIG. 13 shows a bottom perspective view of the furniture frame 26 of the present invention in the couch position. It is noted that the embodiment of FIGS. 12 and 13 show the furniture frame 26 having catch members 37 and 37A located on the sides of the seat section 28. FIG. 12 shows catch member 37 having notches 38 and 39 for receiving a first end 40A of a prop bar 40 and catch member 37A having notches 38A and 39A for receiving a second end 40B of prop bar 40 when the furniture frame 26 is in the couch position.

Figure 14:
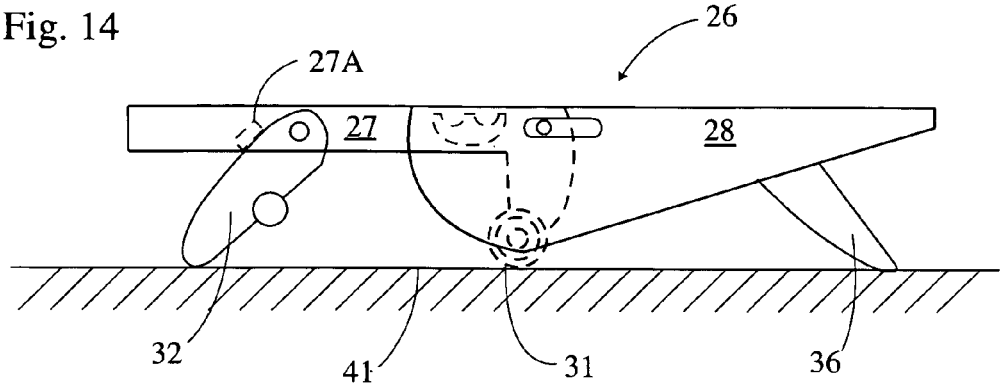
FIG. 14 is a side view showing the furniture frame of FIG. 9 in the bed position.

FIGS. 14–18 show the conversion of furniture frame 26 of the present invention from the bed position to the couch position. Referring to FIG. 14, FIG. 14 is a side view showing the furniture frame 26 in the bed position. In the bed position the backrest support member 32 of the backrest section 27 and the support member 36 of the seat section 28 along with at least one wheel 31 function to cooperatively support the furniture frame 26 on the support surface 41. It is noted that in the bed position, the backrest support member 32 is shown in FIG. 14 engaging a stop member 27A located on the backrest section 27, stop member 27A functioning to limit further movement of the backrest member 32 when the furniture frame 26 is in the bed position.

Figure 15:
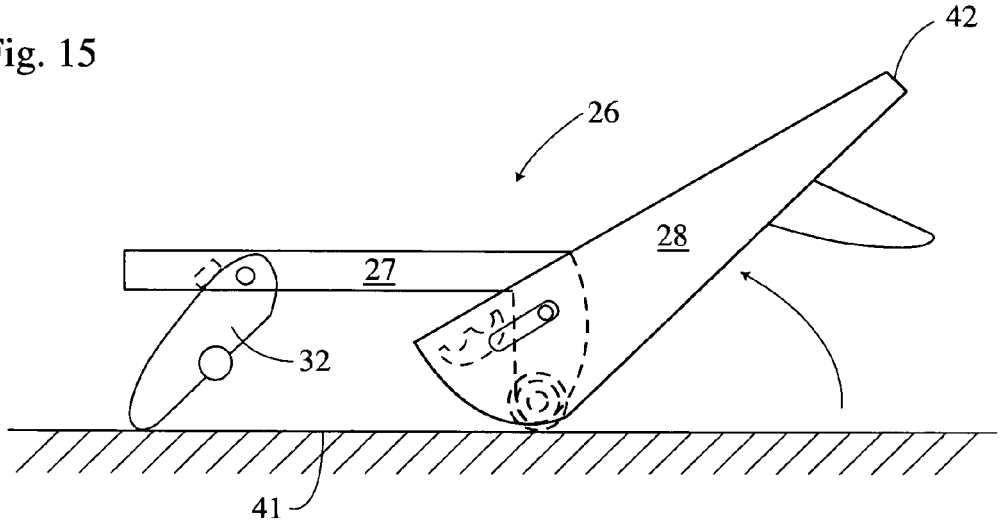
FIG. 15 is a side view showing the furniture frame of FIG. 14 with a front edge of the seat section of the furniture frame raised from a support surface.

FIG. 15 is a side view showing furniture frame 26 with a front edge 42 of the seat section 28 raise from the support surface 42 in the start of the process of converting the furniture frame 26 from the bed position to the couch position. The raising of the front edge 42 of the seat section 28 causes the lifting of the backrest section 27. The continual lifting of the backrest section 27 eventually results in the displacement of the backrest support member 32 from the support surface 41.

It is noted that a feature of the present invention is that once the backrest support member 32 is displaced from the support surface 41, support for the furniture frame 26 on the support surface 41 is primarily through wheel 31. The aforementioned condition allows furniture frame 26 to be effortlessly be rolled to a desired location such as away from a wall or to different locations in a room in a similar fashion to that of a wheelbarrow.

Figure 16:
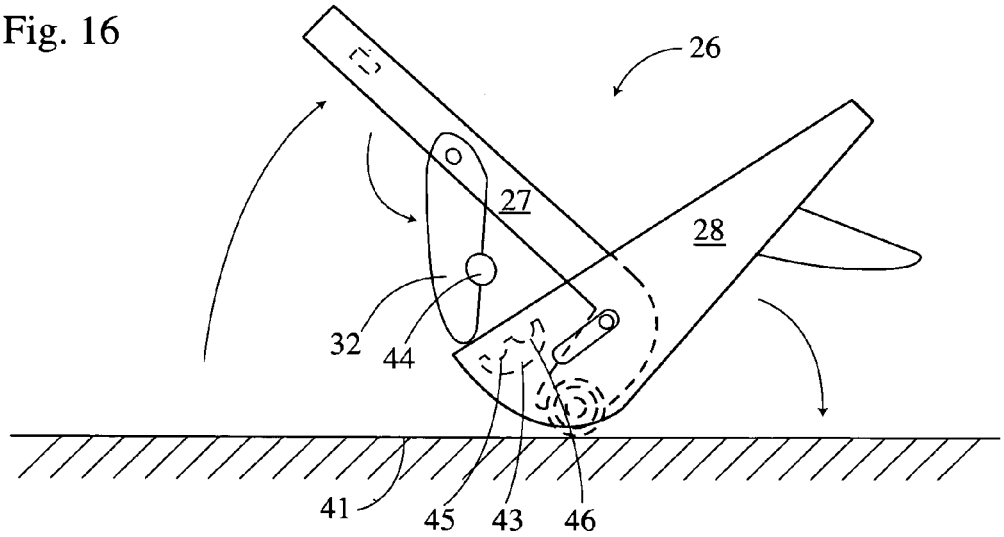
FIG. 16 is a side view showing the furniture frame of FIG. 9 with the backrest section raised and the prop bar aligned with one of the notches of the catch member.

Referring to FIG. 16, once displaced from the support surface 41 the backrest support member 32 along with the prop bar 44 that is secured thereto is free to swingingly move closer to the catch member 43 until the prop bar 44 is aligned with one of the notches 45 and 46 of the catch member 43. Once the prop bar 44 is aligned with one of the notches 45 and 46 of catch member 43, the front edge 42 of the seat member 28 is lowered to allow for one of the notches 45 and 46 of the catch member 43 to receive the prop bar 44.

Figure 17:
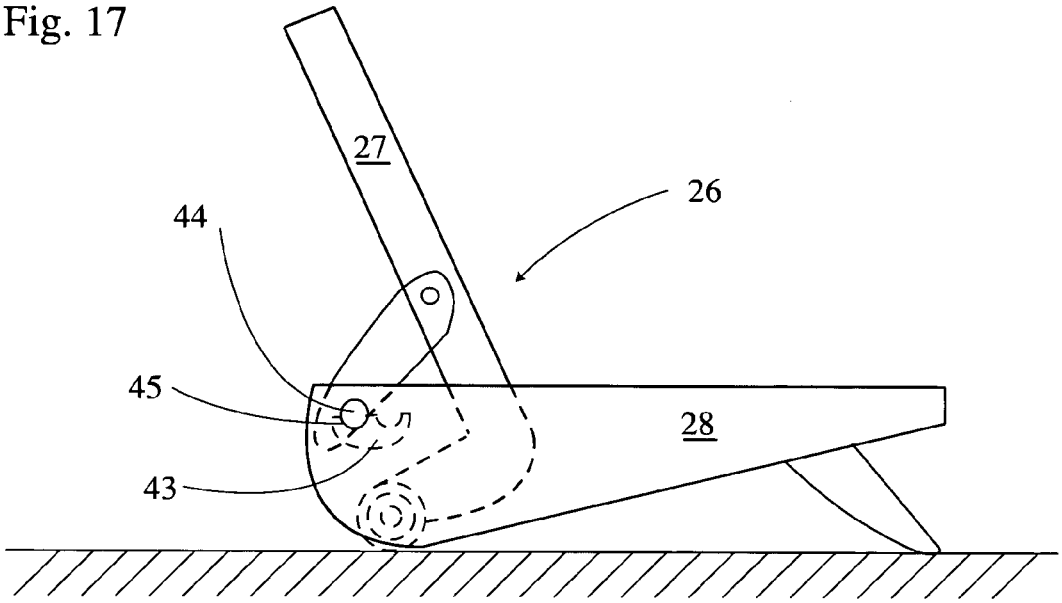
FIG. 17 is a side view showing the engagement of a portion of the prop bar with a first notch of the catch member.

FIGS. 17–20 illustrates the various positions with the elongated slot 25 and protruding member 30 eliminated for purposes of clarity. Referring to FIG. 17, FIG. 17 shows the engagement of a portion of the prop bar 44 with a first notch 45 of catch member 43. The engagement of the prop bar 44 with notch 45 functions to trap the furniture frame 26 in the couch position to prevent further movement of the backrest section 27 with respect to the seat section 28.

Figure 18:
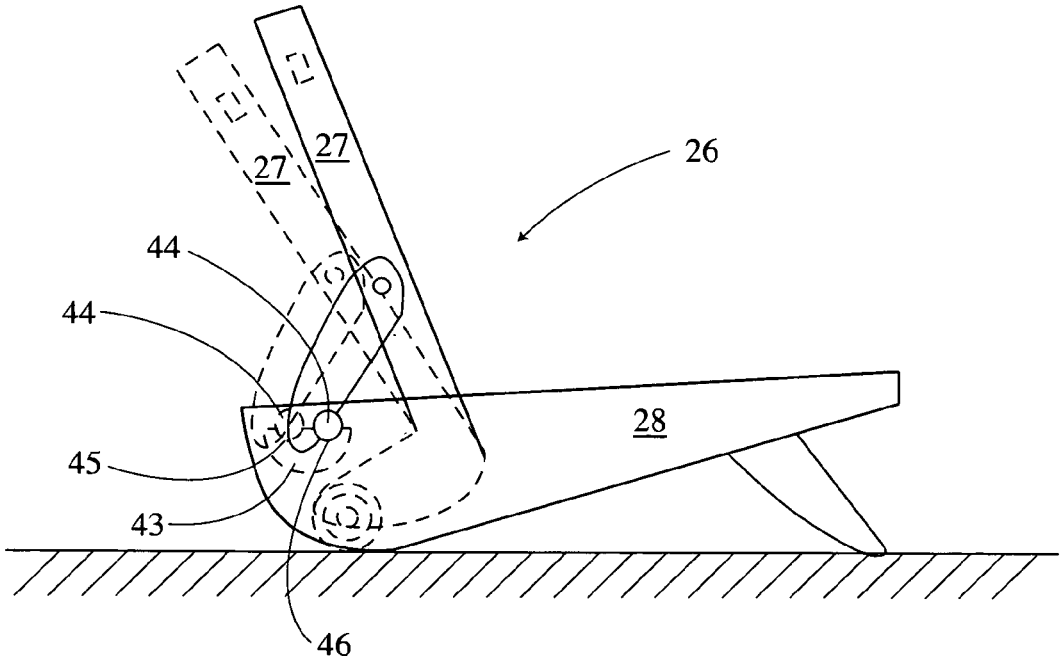
FIG. 18 is a side view showing the movement of the prop bar from the first notch of the catch member to the second notch of the catch member.
Figure 19:
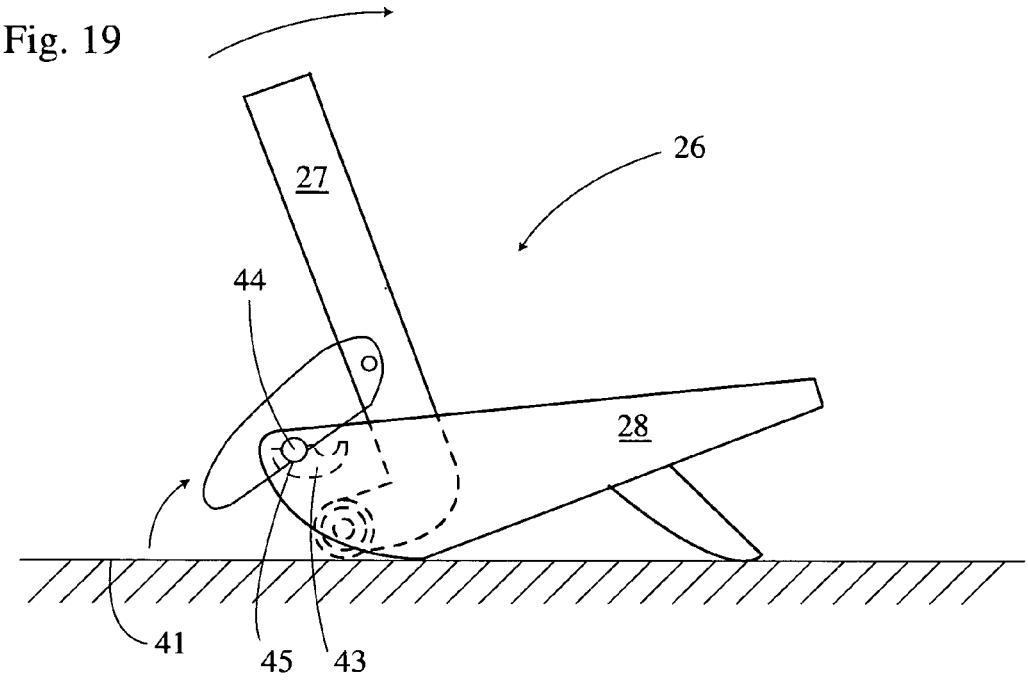
FIG. 19 is a side view showing the backrest section being pull forward towards the seat section so as to set the prop bar in the first notch.
Figure 20:
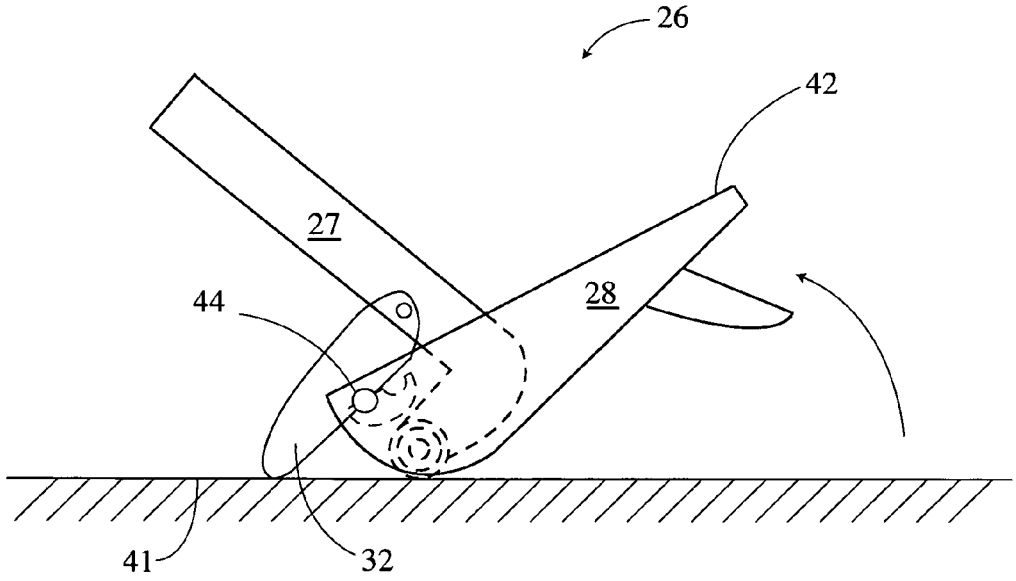
FIG. 20 is a side view showing the front edge of the seat section of the furniture frame raised to bring the backrest support member into contact with the support surface.

Referring to FIG. 18, FIG. 18 is a side view showing the movement of the prop bar 44 from the first notch 45 of catch member 43 to the second notch 46 of catch member 43.

As shown in FIG. 18, movement of the prop bar 44 from the first notch 45 to the second notch 46 increases the upright position of the backrest section 27 of the furniture frame 26 with respect to seat section 28 when the furniture frame 26 is in the couch position. It is noted that when prop bar 44 engages notches 45 and 46, the weight of the backrest section 27 further supports in the securement of the prop bar 44 to the notches 45 and 46 of the catch member 43.

Referring to FIGS. 19–22, in the conversion of the furniture frame 26 from the couch position to the bed position, the user pulls the backrest section 27 forward towards the seat section 28 to set the prop bar 44 in the first notch 45 of the catch member 43 if the prop bar 44 is not already engaging the first notch 45.

Figure 21:
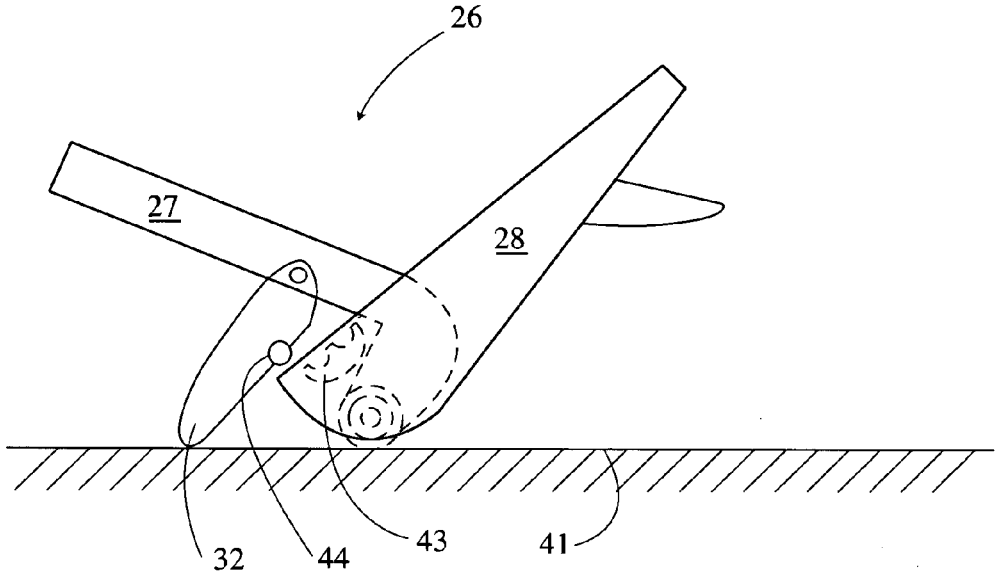
FIG. 21 is a side view showing the front edge of the seat section raised to displace the prop bar from the catch member.

The front end 42 of the seat section 46 is then raised, causing the backrest support member 32 to come into contact with the support surface 41. As shown in FIG. 21, once the backrest support member 32 is in contact with the support surface 41, further raising/lifting of the seat section 28 results in the disengagement of the prop bar 44 from the catch member 43.

Figure 22:
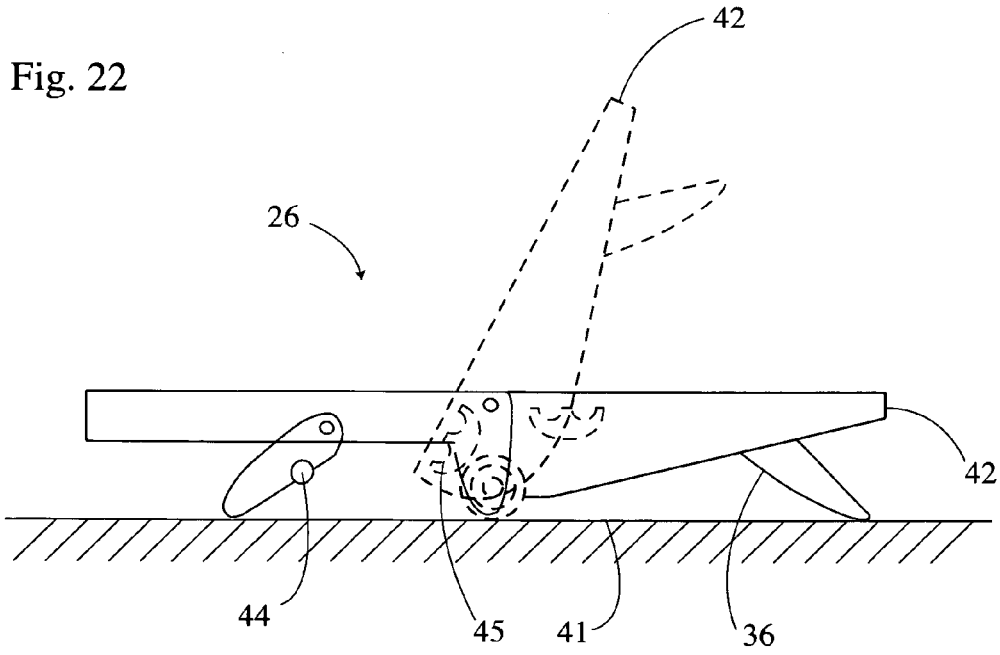
FIG. 22 is a side view showing the lowering of the front end of the seat section to engage the seat support member with the support surface.

Disengagement of the prop bar 44 from the catch member 43 results in a partial transfer of support of furniture frame 26 to the backrest support member 32. As shown in FIG. 22, once the prop bar 44 has been displaced from the notch 45 of the catch member 43, the front end 42 of the seat section 28 is then lowered to permit the seat support member 36 to engage the support surface 41 to finalize the conversion of the furniture frame 26 to the bed position.

A feature of the present invention is that the above conversion of the furniture frame 26 between the bed position and the couch position can be accomplished with the furniture frame 26 being position substantially against a wall surface. That is, the "wall-hugging" feature of the furniture frame 26 of the present invention allows the backrest section 27 of the furniture frame 26 to be place substantially against a wall surface when the furniture frame 26 is in the sofa configuration and remain against the wall even when the furniture frame 26 is converted to the bed position. The aforementioned is accomplished by the front operating feature of the furniture frame 26, that is, due to the fact that the furniture frame 26 can be convertible between the bed position and the couch position solely from the front edge 42 of the seat section 28 of the furniture frame 26.

The present invention, as shown in the embodiment of FIGS. 1–8, include a method of converting a furniture frame 10 from a bed position to a couch position comprising the steps of: lifting a front end 25 of a seat section 12 of the furniture frame 10 in the bed position; moving the protruding member 22 located on a side 19 of the seat section 12 into the groove 14 located on a side 13 of the backrest section 11; bringing the backrest support member 16 and the recess 21 located on the side 19 of the seat section 12 into proximity, raising the front end 25 of the seat section 12 to allow the backrest support member 16 and the a portion of the prop bar 18 to engage the recess 21 of the seat section 12; and lowering the front end 25 of the seat section 12 to trap the prop bar 18 to the recess 21 of the seat section 12 to maintain the furniture frame 11 in the couch position.

The present invention, as shown in the embodiment of FIGS. 1–8, further includes method of converting a furniture frame 10 from the couch position to the bed position comprising the steps of: raising a front end 25 of the seat section 12 of the furniture frame 10 in the couch position; removing the prop bar 18 from the recess 18 of the seat section 12; moving the backrest support member 16 away from the recess 21 of the seat section 21; removing the protruding member 22 of the seat section 12 from the groove 14 of the backrest section 11; and lowering the front end 25 of the seat section 12 of the furniture frame 10 into the bed position.

The present invention, as shown in the embodiments of FIGS. 9–22, also includes a method of converting a furniture frame 26 from the bed position to the couch position comprising the steps of: (1) lifting the front edge 42 of the seat section 28 of the furniture frame 26 in the bed position; (2) bringing the prop bar 44 connected to at least one backrest support member 32 and the notch 45 of the catch member 43 located on the side of the seat section 28 into proximity; (3) raising the front edge 42 of the seat section 28 to allow the backrest support member 32 and a portion of the prop bar 44 to engage the notch 45 of the seat section 28; and (4) lowering the front edge 42 of the seat section 28 to trap the prop bar 44 to the notch 45 of the seat section 28 to maintain the furniture frame 26 in the couch position.

The above method can also include the step of (5) moving the prop bar 44 between the first notch 45 and the second notch 46 of the seat section 28 to adjust the upright position of the furniture frame 26 in the couch position.

The present invention further includes a method of converting a furniture frame 26 from the couch position to the bed position comprising the steps of: (1) raising the front end 42 of the seat section 28 to bring the backrest support member 32 into contact with the support surface 41; (2) further raising the front end 42 of the seat section 27 to displace the prop bar 44 from the catch member 43; (3) transferring partial support of the furniture frame 26 to the backrest support member 32; and (4) lowering the front end 42 of the seat section 28 so the seat support member 36 engages the support surface 41.

The above method can also include the step of (5) moving the backrest section 27 forward towards the seat section 28 to set the prop bar 44 in the first notch 45.

I claim:

1. A furniture frame comprising:

a first section having a first side and a second side, said first section having at least one wheel rotatably secured thereto and at least one support member pivotably secured thereto for supporting said first section;

a prop bar fixedly secured to said at least one pivotable supporting member;

a second section connected to said first section, said second section having a first side and a second side and including at least one support member for supporting said second section; and at least one catch member fixedly secured to one of said sides of said second section, said catch member having at least one prop bar engaging notch for receiving a portion of said prop bar thereon to support said furniture frame in a couch condition.

2. The furniture frame of claim 1 wherein said first section comprises a backrest section and said second section comprises a seat section.

3. The furniture frame of claim 1 wherein said second section is connected to said first section through the engagement of a protruding member located on said first side of said first section with a slot located on the first side of the second section and a protruding member located on said second side of said first section with a slot located on said second side of said second section.

4. The furniture frame of claim 1 wherein said at least one wheel comprises a first wheel and a second wheel rotatably secured to said first section.

5. The furniture frame of claim 1 wherein said at least one support member of said first section comprises a first support member secured to said first side of said first section and a second support member secured to said second side of said first section for supporting said first section.

6. The furniture frame of claim 1 wherein said at least one support member of said second section comprises a first support member secured to said first side of said second section and a second support member secured to said second side of said second section for supporting said second section.

7. The furniture frame of claim 1 wherein said at least one catch member comprises a first catch member secured to an interior surface of said first side of said second section and a second catch member secured to an interior surface of said second side of said second section.

8. The furniture frame of claim 1 wherein said at least one catch member having at least one prop bar engaging notch comprises a catch member having a first prop bar engaging notch and a second prop bar engaging notch for receiving a portion of said prop bar thereon to support said furniture frame in a couch condition.

9. The furniture frame of claim 1 including at least one stop member located on the side of the first section in a fixed condition for limiting the movement of the support member of the first section when the furniture frame is in the bed position.

10. The furniture frame of claim 1 wherein the first side and the second side of the first section comprises a L-shape configuration.

11. A furniture frame comprising:

a first section having a first side and a second side, each of the sides of said first section having a support member pivotably connected thereto for supporting the first section;

at least one wheel rotatably secured to said first section;

a prop bar fixedly secured to said pivotable support members of said first section;

a second section connected to said first section, said second section having a first side and a second side with each of said sides of said second section having a support member for supporting said second section; and at least one catch member fixedly secured to one of said sides of said second section, said catch member having at least one prop bar engaging notch for receiving a portion of said prop bar thereon to support said furniture frame in a couch condition.

12. The furniture frame of claim 11 wherein said first section comprises a backrest section and said second section comprises a seat section.

13. The furniture frame of claim 12 wherein said at least one wheel comprises a first wheel and a second wheel rotatably secured to said backrest section.

14. The furniture frame of claim 12 wherein said seat section is connected to said backrest section through the engagement of a protruding member located on said first side of said backrest section with a slot located on the first side of the seat section and a protruding member located on said second side of said backrest section with a slot located on said second side of said seat section.

15. The furniture frame of claim 12 wherein said at least one catch member comprises a first catch member secured to an interior surface of said first side of said seat section and a second catch member secured to an interior surface of said second side of said seat section.

16. The furniture frame of claim 12 wherein said at least one catch member having at least one prop bar engaging notch comprises a catch member having a first prop bar engaging notch and a second prop bar engaging notch with each notch for receiving a portion of said prop bar thereon to support said furniture frame in a couch condition.

17. The furniture frame of claim 12 wherein the backrest section comprises a L-shaped backrest section.

18. A method of converting a furniture frame from a bed position to a couch position comprising the steps of:

lifting a front edge of a seat section of the furniture frame in the bed position;

bringing a prop bar connected to at least one backrest support member and a notch of a catch member located on the side of the seat section into proximity;

raising the front edge of the seat section to allow the backrest support member and a portion of a prop bar to engage the notch of the seat section; and lowering the front edge of the seat section to trap the portion of the prop bar to the notch of the seat section to maintain said frame in the couch position.

19. The method of claim 18 including the step of lifting said prop bar from said notch of the seat section to a further notch of said seat section to adjust the furniture frame in the couch position.

20. A method of converting a furniture frame from a couch position to a bed position comprising the steps of:

raising a front edge of a seat section of the furniture frame in the couch position;

disengaging a prop bar fixedly secured to at least one pivotable member secured to a backrest support member from a notch of a catch member located on the side of the seat section;

moving the backrest support member away from the catch member of the seat section; and lowering the front edge of the seat section of the frame in the bed.

* * * * *